US010256053B2

(12) United States Patent
Lee

(10) Patent No.: US 10,256,053 B2
(45) Date of Patent: Apr. 9, 2019

(54) CIRCUIT BREAKER INCLUDING SINGLE POLE BREAKING UNIT

(71) Applicant: LSIS CO., LTD., Anyang-si, Gyeonggi-do (KR)

(72) Inventor: Kwangwon Lee, Anyang-si (KR)

(73) Assignee: LSIS CO., LTD., Anyang-si, Gyeonggi-Do (KR)

( * ) Notice: Subject to any disclaimer, the term of this patent is extended or adjusted under 35 U.S.C. 154(b) by 0 days.

(21) Appl. No.: 15/861,292

(22) Filed: Jan. 3, 2018

(65) Prior Publication Data

US 2018/0277316 A1 Sep. 27, 2018

(30) Foreign Application Priority Data

Mar. 21, 2017 (KR) ..... 10-2017-0035516

(51) Int. Cl.

| | |
|---|---|
| ***H01H 9/30*** | (2006.01) |
| ***H01H 9/34*** | (2006.01) |
| ***H01H 1/20*** | (2006.01) |
| ***H01H 71/10*** | (2006.01) |
| ***H01H 71/12*** | (2006.01) |

(Continued)

(52) U.S. Cl.

CPC ..... *H01H 9/342* (2013.01); *H01H 1/2058* (2013.01); *H01H 9/345* (2013.01); *H01H 71/1009* (2013.01); *H01H 71/12* (2013.01); *H01H 2009/305* (2013.01); *H01H 2009/343* (2013.01); *H01H 2071/2427* (2013.01); *H01H 2077/025* (2013.01)

(58) Field of Classification Search

CPC ..... H01H 9/342; H01H 9/345; H01H 1/2058; H01H 71/1009; H01H 71/12; H01H 71/02; H01H 71/24; H01H 71/10

USPC ..... 218/152, 114, 43, 149, 155, 157; 200/336

See application file for complete search history.

(56) References Cited

U.S. PATENT DOCUMENTS 3,506,799 A * 4/1970 Ellsworth ..... H01H 9/342 200/306

3,631,369 A 12/1971 Menocal (Continued)

FOREIGN PATENT DOCUMENTS

CN 2313288 Y 4/1999
CN 101241820 A 8/2008

(Continued)

OTHER PUBLICATIONS

Translation of CN101241820 (A) (original doc published Aug. 13, 2008).*

European Search Report for related European Application No. 17192085.3; report dated Mar. 26, 2018; (8 pages).

*Primary Examiner* — Edwin A. Leon
*Assistant Examiner* — William A Bolton
(74) *Attorney, Agent, or Firm* — K&L Gates LLP

(57) ABSTRACT

Provided is a circuit breaker with a single pole breaking unit including a housing, a movable contact provided in the housing, a fixed contact provided in the housing and contacting or separated from the movable contact, and an extinction unit provided in the housing and configured to extinguish an arc generated when the movable contact and the fixed contact are separated. At least one arc gas discharge passage is formed in the housing to allow an arc gas generated when the movable contact and the fixed contact are separated to be discharged.

8 Claims, 8 Drawing Sheets

(51) Int. Cl.
*H01H 71/24* (2006.01)
*H01H 77/02* (2006.01)

(56) References Cited

U.S. PATENT DOCUMENTS

| | | | | |
|---|---|---|---|---|
| 5,103,198 | A * | 4/1992 | Morel | H01H 9/50 335/6 |
| 8,119,947 | B2 * | 2/2012 | Yang | H01H 71/0207 218/147 |
| 8,487,204 | B2 * | 7/2013 | Scola | H01H 71/0207 218/157 |
| 9,159,508 | B2 * | 10/2015 | Rival | H01H 9/342 |
| 2009/0194510 | A1 | 8/2009 | Dahl | |
| 2013/0126316 | A1 | 5/2013 | Woodson | |
| 2014/0055902 | A1 * | 2/2014 | Ahlert | H01H 9/30 361/115 |

FOREIGN PATENT DOCUMENTS

| | | | |
|---|---|---|---|
| JP | 09-510574 | A | 10/1997 |
| JP | 2010-219033 | A | 9/2010 |
| JP | 2013037895 | A | 2/2013 |
| JP | 2015149297 | A | 8/2015 |
| KR | 1020000033072 | A | 6/2000 |
| KR | 1020060030970 | B1 | 4/2006 |
| KR | 1020060030973 | A | 4/2006 |
| KR | 101010090 | B1 | 1/2011 |
| KR | 1020140139263 | | 10/2014 |

* cited by examiner

CIRCUIT BREAKER INCLUDING SINGLE POLE BREAKING UNIT

CROSS-REFERENCE TO RELATED APPLICATION

Pursuant to 35 U.S.C. § 119(a), this application claims the benefit of earlier filing date and right of priority to Korean Application No. 10-2017-0035516, filed on Mar. 21, 2017, the contents of which is incorporated by reference herein in its entirety.

BACKGROUND OF THE INVENTION

1. Field of the Invention

The present invention relates to a circuit breaker including a single pole breaking unit, and more particularly, to a circuit breaker including a single pole breaking unit for performing a trip operation by arc gas using the single pole breaking unit having a simple structure.

2. Background of the Invention

In general, a circuit breaker is an electronic device that is installed on an electric line and protects a load device by breaking a circuit when an overload or short-circuit accident occurs, and of course, prevents a fire due to an overload or short-circuit accident and protects people's lives.

In addition, such a circuit breaker has a structure in which an extinction device, an opening/closing mechanism unit, and a detection mechanism unit are integrated into an enclosure that is an insulating body, and allows a user to manually manipulate a handle exposed to the outside of the enclosure to control an electric line to be in a closed state or an open state.

Moreover, FIG. 1 is a perspective view showing a conventional circuit breaker. FIG. 2 is a side view showing a single pole breaking unit included in a conventional circuit breaker. FIG. 3 is a cross-sectional view showing a pole breaking unit included in a conventional circuit breaker. Further, FIG. 4 is a perspective view showing a single pole breaking unit included in a conventional circuit breaker. FIG. 5 is a perspective view showing a pressure trip device provided on a side surface of a single pole breaking unit of a conventional circuit breaker. FIG. 6 is a cross-sectional view showing a single pole breaking unit included in a conventional circuit breaker. FIG. 7 is a perspective view showing a state in which an opening/closing mechanism unit is tripped through a pressure trip device provided in a conventional single pole breaking unit.

As shown in FIGS. 1 to 7, a conventional circuit breaker 10 includes an upper cover (not shown) and a lower case 11 made of an insulator and forming an enclosure, an opening/closing mechanism unit 12 having a handle 12*a* for adjusting the ON or OFF state of the circuit breaker 10, a detection mechanism unit 13 for detecting an abnormal current on an electric line, and a single pole breaking unit 20.

At this time, the single pole breaking unit 20 includes a movable contact 21, a fixed contact 23 and an extinction unit 25. When a fault current is applied to the circuit breaker 10, the movable contact 21 and the fixed contact 23 are separated by electromagnetic repulsive force, and an arc is generated between the contacts 21 and 23.

At this time, an arc gas discharge hole 35 is provided on a side surface of the single pole breaking unit 20 so that an arc gas due to arc is discharged to the outside, and the arc gas trips the opening/closing mechanism unit 12 while being discharged to the outside through the arc gas discharge hole 35.

On the other hand, a pressure trip device 30 is provided on a side surface of the single pole breaking unit 20 and is provided on a side surface of the arc gas discharge hole 35.

At this time, the pressure trip device 30 includes a shield 31 for storing an arc gas discharged to the outside, a barrier 33 that maintains each phase to phase insulation and is bent by an arc gas discharged through the arc gas discharge hole 35, a shooter 37 that operates by an arc gas and operates the trip bar 12*b* of the opening/closing mechanism unit 12, and an elastic member 39 for returning the shooter 37 to its original position after the pressure disappears.

Therefore, when a fault current flows in the circuit breaker 10, a current limiting operation is performed in which the contacts 21 and 23 are separated by electromagnetic repulsive force between the movable contact 21 and the fixed contact 23, and at this time, an arc is generated between the contacts 21 and 23, so that the internal pressure becomes large.

At this time, when the gas pressure of an arc gas due to arc is increased, the barrier 33 is bent to expose the arc gas discharge hole 35, and the shooter 37 is pushed upward through the gas pressure of the arc gas discharged through the arc gas discharge hole 35 and drives the trip bar 12*b* to trip the opening/closing mechanism unit 12.

However, in the conventional circuit breaker 10 operated as described above, since the arc gas discharge hole 35 is formed on a side surface of the single pole breaking unit 20, there is a problem that the insulation performance between the respective phases is significantly lowered.

That is, since an arc gas due to arc on each phase is discharged through the arc gas discharge hole 35 when a fault current flows through R, S, and T on the three-phase circuit breaker 10, when the arc is leaked as well as the arc gas, the inter-phase insulation performance deteriorates so that the circuit breaker 10 may not block short-circuit current. In addition, soot and missile generated from short circuit during a trip process due to gas pressure are leaked so that there is a problem that insulation breakdown occurs after a short circuit due to the adhesion between each phase.

Also, in the case of the single pole breaking unit 20 provided in the conventional circuit breaker 10, since the pressure trip device 30 for tripping the opening/closing mechanism unit 12 includes the shield 31, the barrier 33, the shooter 37, and the elastic member 39, the structure is very complicated and difficult to assemble and the number of parts is large, so that the manufacturing cost is greatly increased.

SUMMARY OF THE INVENTION

Therefore, an aspect of the detailed description is to provide a circuit breaker for performing a trip operation by arc gas using a single pole breaking unit having a simple structure.

To achieve these and other advantages and in accordance with the purpose of this specification, as embodied and broadly described herein, there is provided a circuit breaker with a single pole breaking unit including a housing, a movable contact provided in the housing, a fixed contact provided in the housing and contacting or separated from the movable contact, and an extinction unit provided in the housing and configured to extinguish an arc generated when the movable contact and the fixed contact are separated, wherein at least one arc gas discharge passage is formed in the housing to allow an arc gas generated when the movable contact and the fixed contact are separated to be discharged.

The arc gas discharge passage may be formed at least one on a lower surface or a side surface of the housing.

The arc gas discharge passage may include: a first passage having one end where an inlet hole is formed to allow the arc gas to be introduced and formed inclined toward the extinction unit; a second passage formed in a horizontal direction from the first passage; and a third passage having one end where a discharge hole is formed to allow the arc gas to be discharged and formed inclined from the second passage toward the detection mechanism unit.

The circuit breaker may further include a fourth passage having one end where a discharge hole is formed to allow the arc gas to be discharged and formed in a horizontal direction from the third passage toward the detection mechanism unit.

Each of the discharge holes may be positioned adjacent to a lower portion of an armature.

The inlet hole may be formed inclined.

The inlet hole may be positioned adjacent to the fixed contact.

A width in a vicinity of the discharge hole and the inlet hole in the first passage, the third passage, or the fourth passage may be gradually increased as it progressively goes toward the discharge hole and the inlet hole.

The circuit breaker may be tripped as the arc gas is discharged through each of the discharge holes to rotate the armature.

BRIEF DESCRIPTION OF THE DRAWINGS

The accompanying drawings, which are included to provide a further understanding of the invention and are incorporated in and constitute a part of this specification, illustrate exemplary embodiments and together with the description serve to explain the principles of the invention.

In the drawings.

DETAILED DESCRIPTION OF THE INVENTION

Hereinafter, a circuit breaker including a single pole breaking unit according to an embodiment of the present invention will be described in detail with reference to the accompanying drawings.

Figure 1:
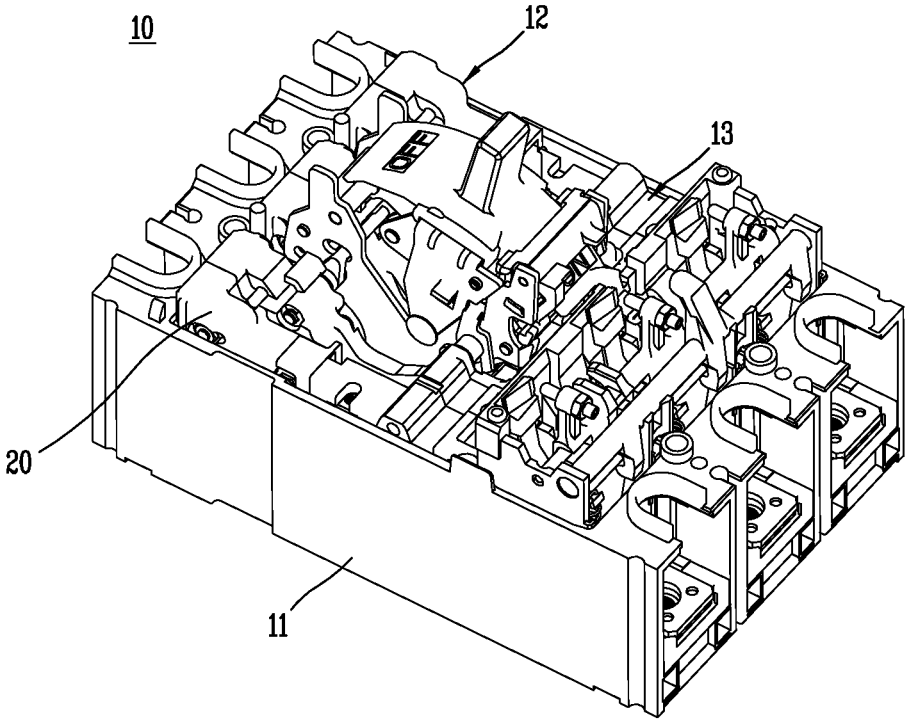
FIG. 1 RELATED ART
FIG. 1 is a perspective view showing a conventional circuit breaker.
Figure 2:
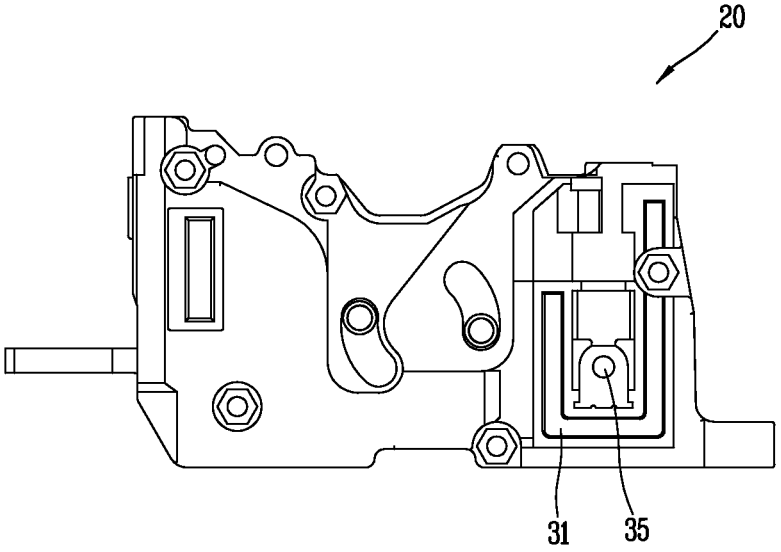
FIG. 2 RELATED ART
FIG. 2 is a side view showing a single pole breaking unit included in a conventional circuit breaker.
Figure 3:
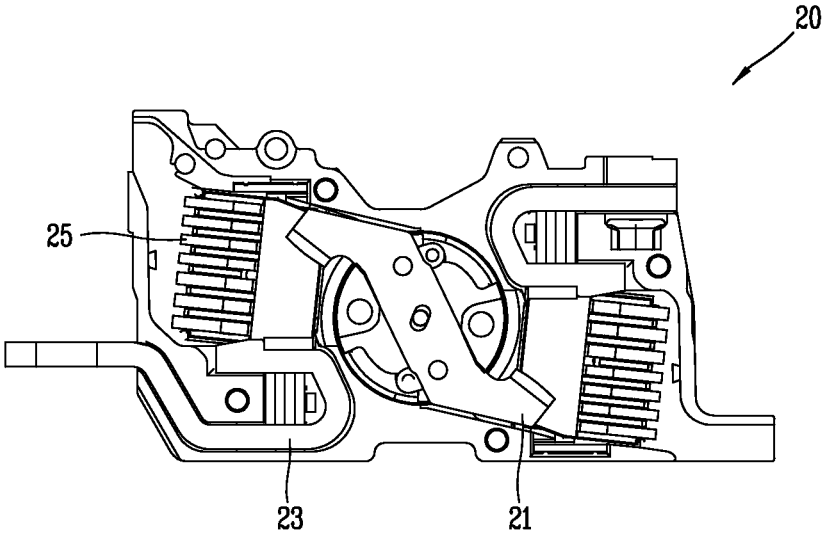
FIG. 3 RELATED ART
FIG. 3 is a cross-sectional view showing a pole breaking unit included in a conventional circuit breaker.
Figure 4:
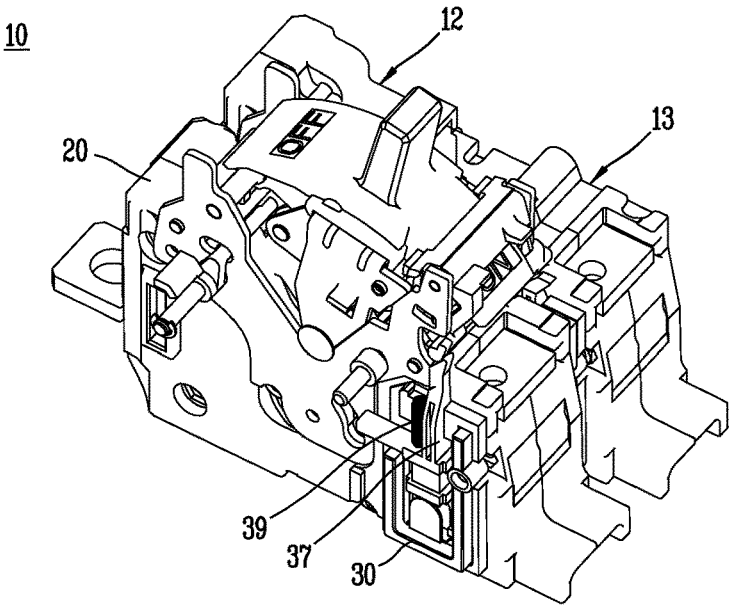
FIG. 4 RELATED ART
FIG. 4 is a perspective view showing a single pole breaking unit included in a conventional circuit breaker.
Figure 5:
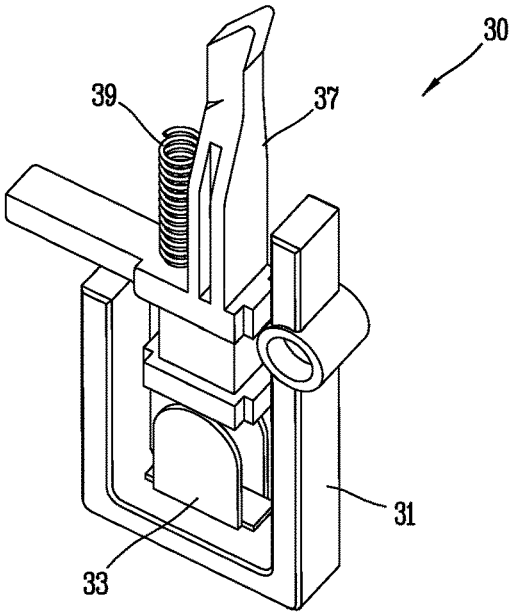
FIG. 5 RELATED ART
FIG. 5 is a perspective view showing a pressure trip device provided on a side surface of a single pole breaking unit of a conventional circuit breaker.
Figure 6:
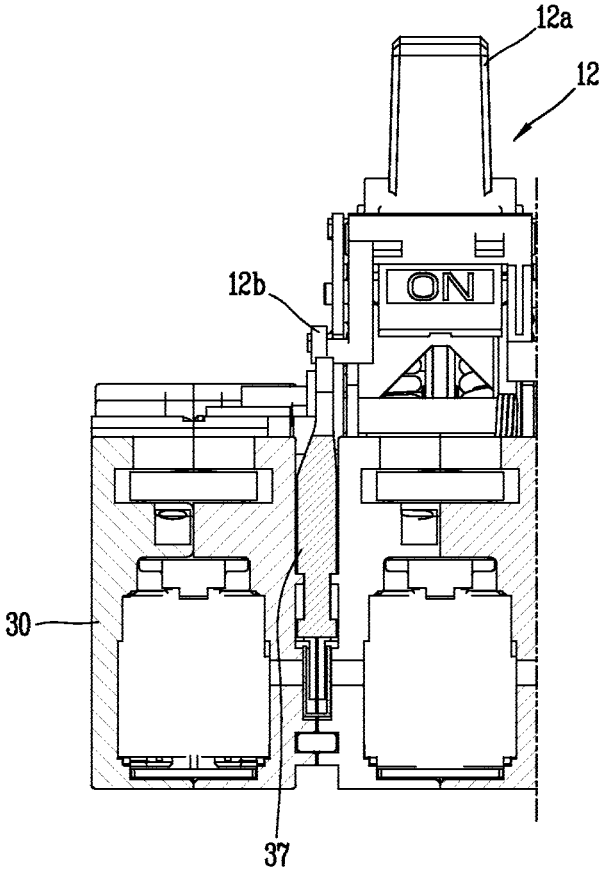
FIG. 6 RELATED ART
FIG. 6 is a cross-sectional view showing a single pole breaking unit included in a conventional circuit breaker.
Figure 7:
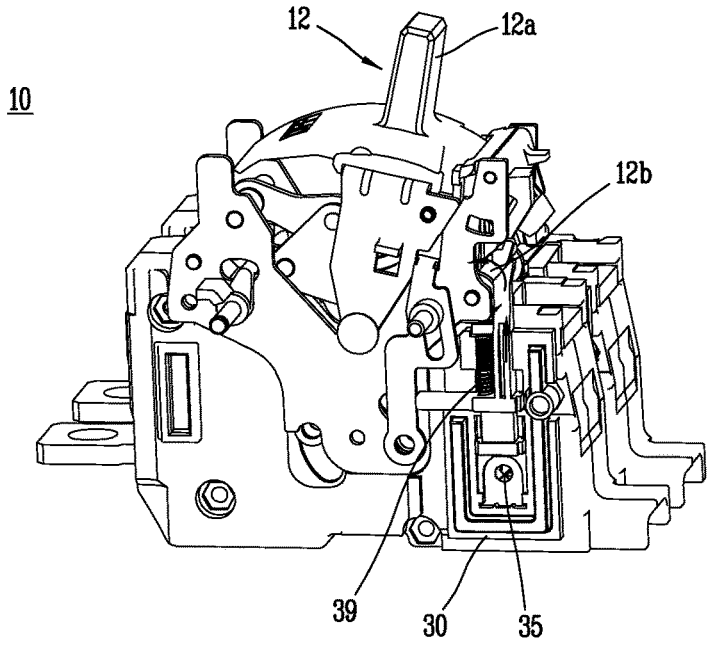
FIG. 7 RELATED ART
FIG. 7 is a perspective view showing a state in which an opening/closing mechanism unit is tripped through a pressure trip device provided in a conventional single pole breaking unit.
Figure 8:
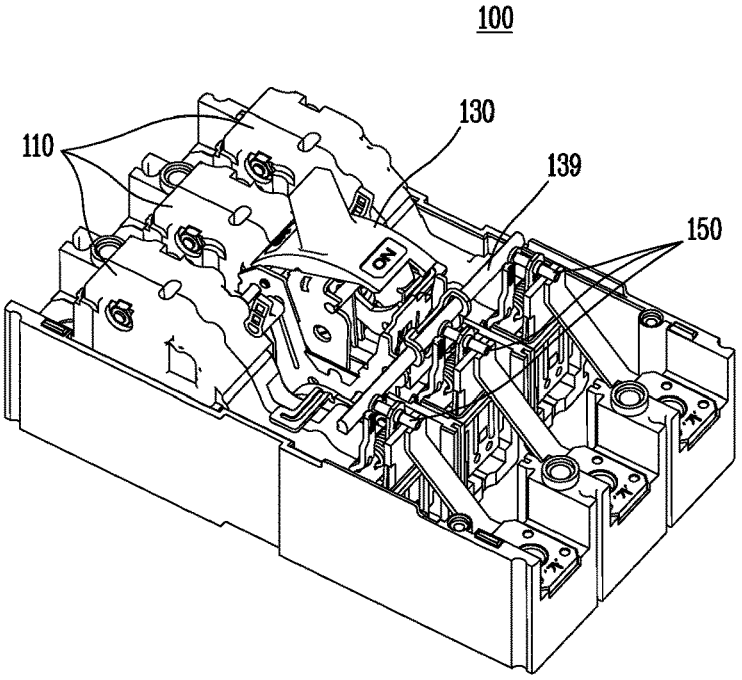
FIG. 8 is a perspective view showing a circuit breaker including a single pole breaking unit according to a first embodiment of the present invention.
Figure 9:
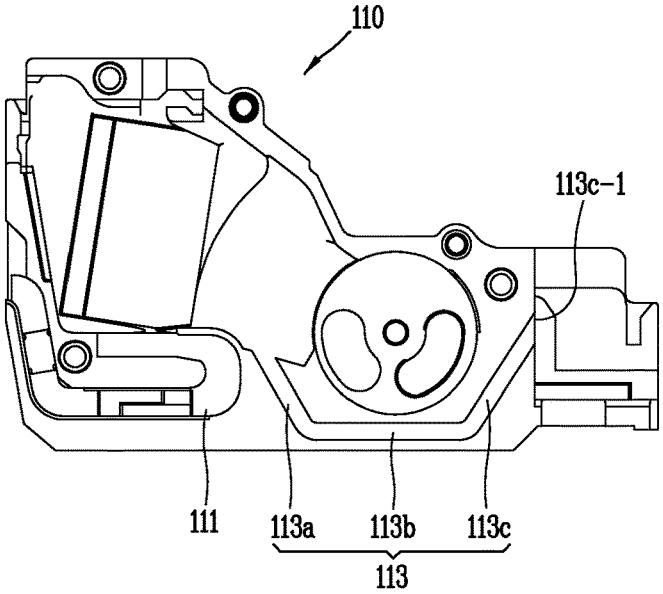
FIG. 9 is a cross-sectional view illustrating a state in which a gas pressure discharge hole is formed in a housing of a single pole breaking unit according to the first embodiment of the present invention.
Figure 10:
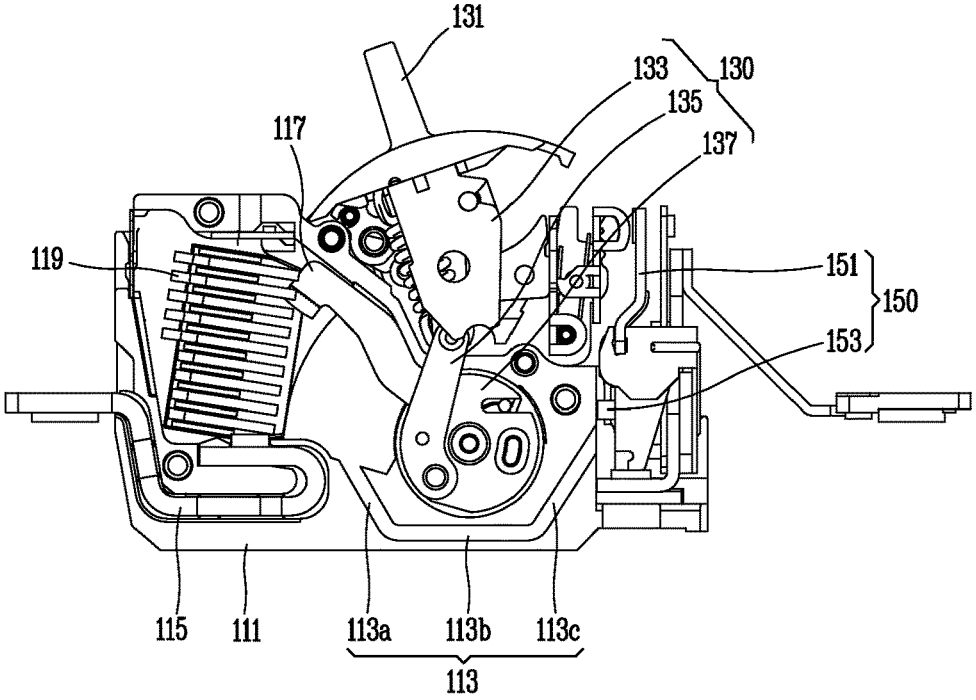
FIG. 10 is a cross-sectional view showing a circuit breaker including a single pole breaking unit according to a first embodiment of the present invention.
Figure 11:
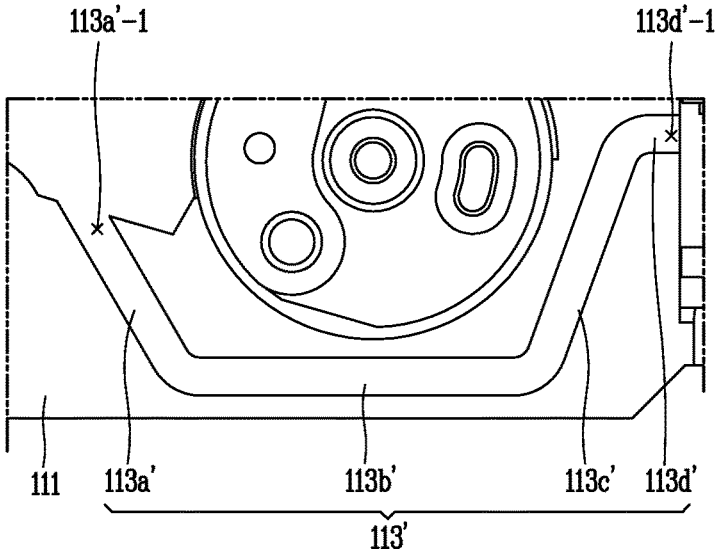
FIG. 11 is a cross-sectional view illustrating a gas pressure discharge hole provided in a single pole breaking unit according to a second embodiment of the present invention.
Figure 12:
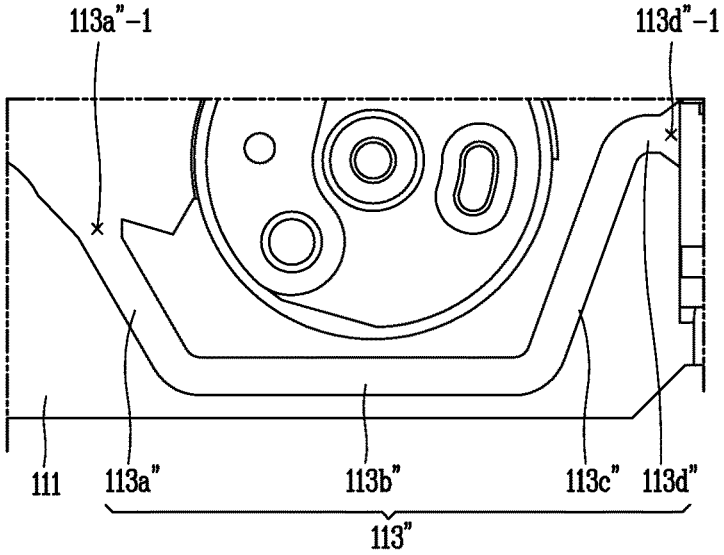
FIG. 12 is a cross-sectional view illustrating a gas pressure discharge hole provided in a single pole breaking unit according to a third embodiment of the present invention.
Figure 13:
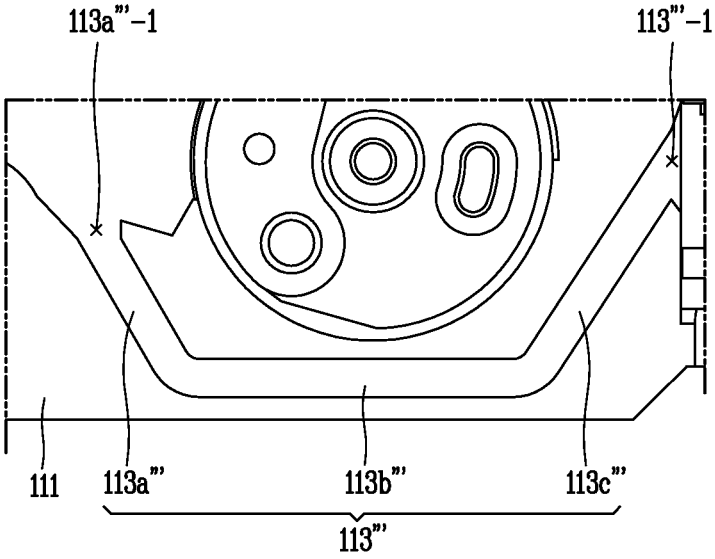
FIG. 13 is a cross-sectional view illustrating a gas pressure discharge hole provided in a single pole breaking unit according to a third embodiment of the present invention.

FIG. 8 is a perspective view showing a circuit breaker including a single pole breaking unit according to a first embodiment of the present invention. FIG. 9 is a cross-sectional view illustrating a state in which a gas pressure discharge hole is formed in a housing of a single pole breaking unit according to the first embodiment of the present invention. FIG. 10 is a cross-sectional view showing a circuit breaker including a single pole breaking unit according to a first embodiment of the present invention. FIG. 11 is a cross-sectional view illustrating a gas pressure discharge hole provided in a single pole breaking unit according to a second embodiment of the present invention. FIG. 12 is a cross-sectional view illustrating a gas pressure discharge hole provided in a single pole breaking unit according to a third embodiment of the present invention. FIG. 13 is a cross-sectional view illustrating a gas pressure discharge hole provided in a single pole breaking unit according to a third embodiment of the present invention.

As shown in FIGS. 8 to 10, the circuit breaker 100 according to the present invention includes an opening/closing mechanism unit 130, a detection mechanism unit 150, and a single pole breaking unit 110.

The opening/closing mechanism unit 130 adjusts the ON or OFF state of the circuit breaker 100 to allow or block the flow of current to the circuit breaker 100.

At this time, the opening/closing mechanism unit 130 includes a handle 131 for allowing a user to turn on or off the breaker 100, a link 133 for supporting the state of the movable contact 117, a lever (not shown) for transmitting the movement of the handle 131 to the link 133, a latch holder 135 for restraining a latch (not shown) or releasing the latch from the restrained state, and a shaft 137 rotating with a movable contact 117 in connection with the trip bar 139 and the link 133.

The detection mechanism unit 150 includes a magnet (not shown) and an armature 151 that moves by an electromagnetic force when a fault current is generated. When a current flows above an inspection region, the armature 151 is bent toward the magnet by the electromagnetic force generated from the magnet so as to move the trip bar 139 and trip the opening/closing mechanism unit 130.

In addition, when a fault current is applied, arc gas is discharged from the single pole breaking unit 110, and the arc gas presses the armature 151 to cause the opening/closing mechanism unit 130 to trip.

At this time, the armature 151 is rotatably connected toward the trip bar 139 through the rotation coupling part 153 and when the arc gas discharged through the single pole breaking unit 110 presses a lower portion of the armature 151, the armature 151 is rotated toward the trip bar 139 so as to rotate the trip bar 139 and cause the opening/closing mechanism unit 130 to be in a trip state.

When a fault current is applied, the single pole breaking unit 110 discharges an arc gas toward the armature 151 and presses the armature 151 to trip the opening/closing mechanism unit 130 through the armature 151.

The single pole breaking unit 110 is a type of opening/closing contact portion for each AC pole, which is provided for each pole, that is, AC three poles (i.e., three phases) of R, S, and T, and includes a housing 111 of which exterior is the made of synthetic resin excellent in electrical insulation performance for electrical insulation between poles (i.e., phases).

The movable contact 117 and the fixed contact 115 are provided in the housing 111 of the single pole breaking unit 110 as an opening/closing contact portion for each AC pole.

Also, when abnormal current such as short circuit current flows on the circuit, an extinction unit 119 is provided to extinguish an arc generated between the contact points of the movable contact 117 and the fixed contact 115.

At this time, the movable contact 117 is rotatably supported by the shaft 137 subordinately or independently.

Therefore, in relation to the single pole breaking unit 110, when a fault current is applied and the movable contact 117 and the fixed contact 115 are separated due to electromagnetic repulsive force, as a current limiting operation is performed, an arc is generated. At this time, the inner pressure of the single pole breaking unit 110 is greatly increased, and the arc gas is discharged to the outside to trip the opening/closing mechanism unit 130.

Meanwhile, at least one arc gas discharge passage 113 for allowing an arc gas generated upon separation of the movable contact 117 and the fixed contact 115 to be discharged toward the armature 151 of the detection mechanism unit 150 is formed in the housing 111.

At this time, at least one arc gas discharge passage 113 above is formed on the lower surface or the side surface of the housing 111.

Therefore, when a fault current is applied to the circuit breaker 100, an electromagnetic repulsive force is generated between the fixed contact 115 and the movable contact 117 so that each of the contacts 115 and 117 is separated and an arc is generated. Then, the arc gas is discharged through the arc gas discharge passage 113 to the armature 151 of the detection mechanism unit 150 to rotate the armature 151, thereby tripping the opening/closing mechanism unit 130.

In addition, the arc gas discharge passage 113 includes a first passage 113*a*, a second passage 113*b*, and a third passage 113*c*.

The arc gas generated when the fixed contact 115 and the movable contact 117 are separated is preferentially introduced into the first passage 113*a*.

At this time, the first passage 113*a* is formed inclined toward the extinction unit 119, and an inlet hole 113*a*-1 is formed at one end to allow an arc gas to flow therein.

Accordingly, when a fault current is applied and the movable contact 117 and the fixed contact 115 are separated from each other, an arc gas is preferentially introduced into the first passage 113*a* through the inlet hole 113*a*-1, and then moves toward the second passage 113*b*.

At this time, the inlet hole 113*a*-1 may be formed inclined, and as the fixed contact 115 and the movable contact 117 are separated, when an arc gas is generated, it moves in an inclined direction. Therefore, due to the inclined inlet hole 113*a*-1, the arc gas may be quickly introduced into the first passage 113*a*.

In addition, the inlet hole 113*a*-1 is positioned adjacent to the fixed contact 115 so that the inlet hole 113*a*-1 is positioned at a location where an arc gas is mainly generated, thereby quickly performing the inflow of the arc gas.

The second passage 113*b* is formed in a horizontal direction from the first passage 113*a* so that the arc gas introduced into the first passage 113*a* moves horizontally by a predetermined length through the second passage 113*b*.

An arc gas generated upon separation of the fixed contact 115 and the movable contact 117 is introduced into the third passage 113*c* through the first passage 113*a* and the second passage 113*b* and then, is finally discharged toward the detection mechanism unit 150.

At this time, the third passage 113*c* is formed inclined from the second passage 113*b* toward the detection mechanism unit 150, and the discharge hole 113*c*-1 is formed at one end to discharge the arc gas.

Accordingly, the arc gas generated when the movable contact 117 and the fixed contact 115 are separated due to a fault current is introduced through the first passage 113*a* and after passing through the second passage 113*b* and then the third passage 113*c*, is discharged to the outside of the single pole breaking unit 110 through the discharge hole 113*c*-1 so as to press the armature 151 of the detection mechanism unit 150, thereby rotating the armature 151 toward the trip bar 139 to trip the opening/closing mechanism unit 130.

Furthermore, as shown in FIG. 11, like the first embodiment, an arc gas discharge passage 113' provided in the single pole breaking unit 110 according to the second embodiment of the present invention includes a first passage 113*a*', a second passage 113*b*', and a third passage 113*c*'. At this time, a fourth passage 113*d*' formed in a horizontal direction from the third passage 113*c*' to the detection mechanism unit 150 may be further formed at one end of the third passage 113*c*'.

That is, the fourth passage 113*d*' is formed in a horizontal direction toward the detection mechanism unit 150, and a discharge hole 113*d*'-1 is formed at one end to discharge the arc gas.

Therefore, as the arc gas passing the inclined third passage 113*c*' passes through the fourth passage 113*d*' formed in a horizontal direction, when the arc gas presses a lower portion of the armature 151, it presses the lower portion in a horizontal direction instead of an inclined direction, thereby rotating the armature 151 more quickly. Therefore, the trip operation of the opening/closing mechanism unit 130 may be performed rapidly.

Moreover, as shown in FIG. 12, an arc gas discharge passage 113" provided in a single pole breaking unit 110 according to the third embodiment of the present invention includes a first passage 113", a second passage 113*b*", a third passage 113*c*", and a fourth passage 113*c*'".

An arc gas generated when the fixed contact 115 and the movable contact 117 are separated is introduced into the first passage 113" and an inlet hole 113*a*"-1 is formed at one end to allow the arc gas to flow therein.

At this time, by allowing the width of the first passage 113" in the vicinity of the inlet hole 113*a*"-1 to be gradually increased toward the inlet hole 113*a*"-1, an arc gas generated when the fixed contact 115 and the movable contact 117 are separated may be quickly introduced into the first passage 113".

In addition, a discharge hole 113*d*"-1 is formed in the fourth passage 113*d*" so as to discharge an arc gas, and by allowing the width of the fourth passage 113*d*" in the vicinity of the discharge hole 113*d*"-1 to be gradually increased toward the discharge hole 113*d*"-1, the arc gas introduced into the fourth passage 113*d*" is rapidly discharged through the discharge hole 113*d*"-1.

On the other hand, as shown in FIG. 13, like the first embodiment, an arc gas exhaust passage 113''' provided in a single pole breaking unit 110 according to the fourth embodiment of the present invention includes a first passage 113*a*''', a second passage 113*b*''', and a third passage 113*c*''.

An arc gas generated when the fixed contact 115 and the movable contact 117 are separated is introduced into the first passage 113*a*''' and an inlet hole 113*a*'''-1 is formed at one end to allow the arc gas to flow therein.

At this time, by allowing the width of the first passage 113*a*''' in the vicinity of the inlet hole 113*a*'''-1 to be gradually increased toward the inlet hole 113*a*'''-1, an arc gas is quickly introduced into the first passage 113''' through the inlet hole 113*a*'''-1.

The second passage 113*b*''' provides a path through which the arc gas introduced into the first passage 113*a*''' moves in a horizontal direction, and the third passage 113*c*''' is formed inclined toward the detection mechanism unit 150, and an exhaust hole 113*c*'''-1 is formed therein to discharge the arc gas toward the detection mechanism unit 150.

At this time, by allowing the width of the third passage 113*c*''' in the vicinity of the discharge hole 113*c*'''-1 to be gradually increased toward the discharge hole 113*c*'''-1, the arc gas is moved in an inclined direction through the third passage 113*c*''' and then, a larger amount of the arc gas is discharged to the detection mechanism unit 150 through the discharge hole 113*c*'''-1, so that the trip operation through the detection mechanism unit 150 may be performed quickly.

At this time, the discharge holes 113*d*, 113*d*', 113*d*'', and 113*c*'''-1 are positioned adjacent to the lower portion of the armature 151. As soon as an arc gas is discharged through the respective discharge holes 113*d*, 113*d*', 113*d*'', and 113*c*'''-1 provided in the third passages 113*c*, 113*c*', 113*c*'', and 113*c*''' or the fourth passage 113*d*, 113*d*', and 113*d*'', the lower portion of the armature 151 is pressed without delay so that the armature 151 is rapidly rotated, thereby quickly tripping the opening/closing mechanism unit 130.

In the case of the present invention configured to operate as above, by forming the arc gas discharge passage 113 inside the housing 111 of the single pole breaking unit 110 provided in the circuit breaker 100 in order to connect the extinction unit 119 and the detection mechanism unit 150, when the opening/closing mechanism unit 130 is tripped using an arc gas generated during a short circuit, the circuit breaker 100 prevents the insulation performance between each phase from deteriorating, thereby improving the reliability of the operation of the circuit breaker 100.

Also, when a fault current is applied, a current limiting operation is performed quickly. At this time, since the detection mechanism unit 150 does not detect the inflow of the fault current, the circuit breaker 100 blocks the fault current only by the current limiting operation of the single pole breaking unit 110. At this time, when the detection mechanism unit 150 is not operated and the opening/closing mechanism unit 130 is displayed as a closed state, the armature 151 of the detection mechanism unit 150 is operated using the gas pressure of the arc gas generated when the short circuit is interrupted. Therefore, it is possible to trip the opening/closing mechanism unit 130 irrespective of the cut-off time by the current limiting operation.

Further, as the arc gas discharge passage 113 is formed in the single pole breaking unit 110 and the arc gas discharged through the arc gas discharge passage 113 presses the armature 151 provided in the detection mechanism unit 150, without any other components, it is possible to perform the trip operation of the opening/closing mechanism unit 130 through the single pole breaking unit 110 through a simple structure.

Further, since there is no need to provide another component for performing the pressure trip operation by the arc gas, the structure is simplified and the manufacturing cost is reduced.

In addition, as the first passage 113*a* is formed inclined and also the inlet hole 113*a*-1 is formed inclined, an arc gas generated during the separation of the fixed contact 115 and the movable contact 117 is quickly introduced into the arc gas discharge passage 113, so that the trip operation of the opening/closing mechanism unit 130 is performed quickly through the arc gas.

By allowing the width of the first passage 113*a*'' in the vicinity of the inlet hole 113*a*''-1 and the width of the fourth passage 113*d*'' in the vicinity of the discharge holes 113*c*'''-1 and 113*d*''-1 to be gradually increased to a certain extent, the arc gas generated when the movable contact 117 and the fixed contact 115 are separated may easily flow into the arc gas discharge passages 113'' and 113''', or discharged therefrom.

Further, as the fourth passage 113*d*' is formed in a horizontal direction, when the arc gas is discharged toward the detection mechanism unit 150 through the discharge hole 113*d*'-1, by allowing the direction of the gas pressure that applies pressure to the armature 151 to be in a horizontal direction through the arc gas, the armature 151 rotates faster through the gas pressure.

Also, as the inlet holes 113*a*-1, 113*a*'-1, 113*a*''-1, and 113*a*'''-1 formed in the first passages 113*a*, 113*a*', 113*a*'', and 113*a*''' are formed in the vicinity of the fixed contact 115, the arc gas generated when the fixed contact 115 and the movable contact 117 are separated is quickly introduced into the arc gas discharge passages 113, 113', 113'', and 113'''.

Moreover, by allowing the discharge holes 113*c*-1, 113*d*'-1, 113*d*''-1, and 113*c*'''-1 formed in the third passages 113*c*, 113*c*', 113*c*'', and 113*c*''' or the fourth passages 113*d*' and 113*d*'' to be positioned adjacent to the lower portion of the armature 151, as soon as the arc gas is discharged through the third passages 113*c*, 113*c*', 113*c*'', and 113*c*''' or the fourth passages 113*d*' and 113*d*'', the armature 151 is pressed without delay.

As described above, in relation to the circuit breaker including the single pole breaking unit according to the present invention, by forming the arc gas discharge passage inside the housing of the single pole breaking unit provided in the circuit breaker in order to connect the extinction unit and the detection mechanism unit, the arc gas is prevented from being discharged to a side surface. When the opening/closing mechanism unit is tripped using an arc gas generated during a short circuit, the circuit breaker prevents the insulation performance between each phase from deteriorating, thereby improving the reliability of the operation of the circuit breaker.

Further, as the arc gas discharge passage is formed in the single pole breaking unit and the arc gas discharged through the arc gas discharge passage presses the armature provided in the detection mechanism unit, without any other components, it is possible to perform the trip operation of the opening/closing mechanism unit through the single pole breaking unit through a simple structure.

In addition, as the first passage is formed inclined and also the inlet hole is formed inclined, an arc gas generated during the separation of the fixed contact and the movable contact is quickly introduced into the arc gas discharge passage, so that the trip operation of the opening/closing mechanism unit is performed quickly through the gas pressure of the arc gas.

Furthermore, by allowing the width of the first passage in the vicinity of the inlet hole and the width of the fourth passage in the vicinity of the discharge hole to be gradually increased to a certain extent, the arc gas generated when the movable contact and the fixed contact are separated may easily flow into the arc gas discharge passage, or discharged therefrom.

Further, as the fourth passage is formed in a horizontal direction, when the arc gas is discharged toward the detection mechanism unit through the discharge hole, by allowing the direction of the gas pressure that applies pressure to the armature to be in a horizontal direction through the arc gas, the armature rotates faster through the gas pressure.

Moreover, as the inlet hole formed in the first passage is formed in the vicinity of the fixed contact, the arc gas generated when the fixed contact and the movable contact are separated is quickly introduced into the arc gas discharge passage.

Additionally, by allowing the discharge hole formed in the third passage or the fourth passage to be positioned adjacent to the lower portion of the armature, as soon as the arc gas is discharged through the third passage or the fourth passage, the armature is pressed without delay.

As the present features may be embodied in several forms without departing from the characteristics thereof, it should also be understood that the above-described embodiments are not limited by any of the details of the foregoing description, unless otherwise specified, but rather should be construed broadly within its scope as defined in the appended claims, and therefore all changes and modifications that fall within the metes and bounds of the claims, or equivalents of such metes and bounds are therefore intended to be embraced by the appended claims.

What is claimed is:

1. A circuit breaker comprising a single pole breaking unit including a housing, a movable contact provided in the housing, a fixed contact provided in the housing and contacting or separated from the movable contact, an extinction unit provided in the housing and configured to extinguish an arc generated when the movable contact and the fixed contact are separated, and a detection mechanism unit to detect a fault current, wherein at least one arc gas discharge passage is formed in the housing to allow an arc gas generated when the movable contact and the fixed contact are separated to be discharged, wherein the at least one arc gas discharge passage includes an inlet hole that is formed at the extinction unit to allow the arc gas to be introduced and a discharge hole that is formed at the detection mechanism unit to allow the arc gas to be discharged, and the circuit breaker is tripped as the arc gas discharged through the discharge hole rotates an armature of the detection mechanism unit.

2. The circuit breaker of claim 1, wherein the at least one arc gas discharge passage is formed on a lower surface or a side surface of the housing.

3. The circuit breaker of claim 2, wherein the arc gas discharge passage comprises:

a first passage having one end where the inlet hole is formed to allow the arc gas to be introduced and formed inclined toward the extinction unit;

a second passage formed in a horizontal direction from the first passage; and a third passage having one end where the discharge hole is formed to allow the arc gas to be discharged and formed inclined from the second passage toward the detection mechanism unit.

4. The circuit breaker of claim 3, further comprising a fourth passage having one end where the discharge hole is formed to allow the arc gas to be discharged and formed in a horizontal direction from the third passage toward the detection mechanism unit.

5. The circuit breaker of claim 4, wherein a width in a vicinity of the discharge hole and the inlet hole in the first passage, the third passage, or the fourth passage is gradually increased as it progressively goes toward the discharge hole and the inlet hole.

6. The circuit breaker of claim 3, wherein each of the discharge holes is positioned adjacent to a lower portion of the armature.

7. The circuit breaker of claim 3, wherein the inlet hole is formed inclined.

8. The circuit breaker of claim 3, wherein the inlet hole is positioned adjacent to the fixed contact.

* * * * *